United States Patent [19]

Dieban et al.

[11] Patent Number: 4,633,625

[45] Date of Patent: Jan. 6, 1987

[54] PEDESTAL UNIT HAVING RAISABLE AND LOWERABLE PLATFORMS

[75] Inventors: Peter H. Dieban, Gustavsburg; Helmut Ziller, Wesel, both of Fed. Rep. of Germany

[73] Assignee: Man Gutehoffnungshuette GmbH, Nuremberg, Fed. Rep. of Germany

[21] Appl. No.: 535,378

[22] Filed: Sep. 23, 1983

[30] Foreign Application Priority Data

Sep. 29, 1982 [DE] Fed. Rep. of Germany ..... 3235990

[51] Int. Cl.[4] ..... E04H 3/26

[52] U.S. Cl. ..... 52/30; 52/6; 52/64; 108/91

[58] Field of Search ..... 52/7–10, 52/64, 30, 121, 111, 113; 108/91; 182/63, 131, 130, 141, 147, 150, 157

[56] References Cited

U.S. PATENT DOCUMENTS

| | | | |
|---|---|---|---|
| 160,485 | 3/1875 | Thomas | 52/111 |
| 222,143 | 12/1879 | Mackaye | 52/30 |
| 445,720 | 2/1891 | Smitter | 182/131 |
| 463,848 | 11/1891 | Van Dereer | 52/30 |
| 749,736 | 1/1904 | Jetley | 52/111 |
| 1,227,681 | 5/1917 | Simms | 108/91 |
| 1,544,150 | 6/1925 | Hasait | 52/30 |
| 1,881,475 | 10/1932 | Gibson | 108/91 |
| 2,409,027 | 10/1946 | Fergusson | 108/91 |
| 2,430,179 | 11/1947 | Lanchester | 182/63 |
| 2,948,363 | 8/1960 | Hopfeld | 182/63 |
| 3,394,507 | 7/1968 | Rife | 52/10 |
| 3,537,546 | 11/1970 | Klosh | 182/131 |
| 4,238,911 | 12/1980 | Frosch | 52/111 |

FOREIGN PATENT DOCUMENTS

| | | | |
|---|---|---|---|
| 1917197 | 10/1970 | Fed. Rep. of Germany | 52/30 |
| 552824 | 5/1923 | France . | |
| 767327 | 10/1980 | U.S.S.R. | 52/7 |

*Primary Examiner*—John E. Murtagh
*Attorney, Agent, or Firm*—Felfe & Lynch

[57] ABSTRACT

A pedestal unit has first and second structures each with a raisable and lowerable platform on a corresponding end. The first structure is telescopically nestable in the second and the second structure is similarly nestable in a framework having the platform raising and lowering mechanism therein to define the pedestal unit.

9 Claims, 5 Drawing Figures

PEDESTAL UNIT HAVING RAISABLE AND LOWERABLE PLATFORMS

BACKGROUND OF THE INVENTION

This invention relates to a pedestal unit having raisable and lowerable platform for a theater stage.

It is common practice to divide theater stages into an array of pedestals having platforms which can be raised and lowered by hydraulic pistons. It has proved to be a drawback of these stages that only one platform per pedestal can be raised and lowered. In contrast to this, it would be an advantage if, in order to represent enclosed spaces, for instance, a second platform were available to cover the spaces at the top.

SUMMARY OF THE INVENTION

The present invention therefore has for its object providing a pedestal having at least two platforms which can raised and lowered in synchronism or independently, one of the platform also being tiltable about at least one horizontal axis and, in particular, a plurality of such pedestals in an array for a theater stage.

This object is achieved with the invention in that a raisable and lowerable pedestal unit has first and second structures each having a platform on a corresponding end. The first structure telescopically nests into the second with the platform of the first structure on top of the platform of the second structure, i.e. farthest from the structures. An arrangement is provided for raising and lowering the first structure relative to the second and, independently, raising and lowering the first structure with the second so that the platforms of the structures can be variably spaced from each other as well as raised and lowered relative to a fixed reference.

Preferably, the first and second structures are frameworks having posts, at corresponding positions, such as corners, of cross sections transverse to the directions in which the structures are raisable and lowerable. The arrangement for raising and lowering the structures preferably also is a framework about the others to form the pedestal unit with posts in corresponding cross section and in which the second structure telescopically nests. The posts of the frameworks of the first and second structures and of the second structure and arrangement for raising and lowering the structures preferably slidably interfit for guidance all along their lengths. This provides stable guidance in both the raising and lowering directions and directions transverse thereto.

The mechanism for the arrangement for raising and lowering the first and second platformed structures preferably is a separate motor-driven chain and counterweight unit for each structure. These units may be mounted within the frameworks and advantageously include pulley systems on the chains to reduce the raising and lowering movement of the counterweights relative to the movement of the respective first and second platformed structures and thus reduce the height of the pedestal. Another way of considering the latter is that each counterweight weighs more than the respectively associated structure.

These preferred features cooperate so that the pedestal unit can be assembled from modular framework sections to fit different stage designs and to reduce the foundation depth required relative to the height to which the platforms can be raised synchronously or independently.

As a further preferred feature, the platform on the first structure is pivoted to tilt on at least one axis normal to the directions of raising and lowering and preferably both on a universal joint. Control of the tilt is advantageously provided with screws threaded into the corner posts of the preferred framework form of the first structure and engaging the platform thereon for further intercooperation of the preferred features. When an array of such pedestals is then assembled with platforms having cross sections relative to the directions of raising and lowering which interfit into a stage, the entire stage or sections thereof may be variably inclined by tilting the platforms of progressively raised pedestals in the array.

DESCRIPTION OF THE DRAWINGS

A preferred embodiment of the invention which is intended to illustrate but not to limit the invention is illustrated in the drawings in which.

DESCRIPTION OF THE PREFERRED EMBODIMENT

Figure 1:
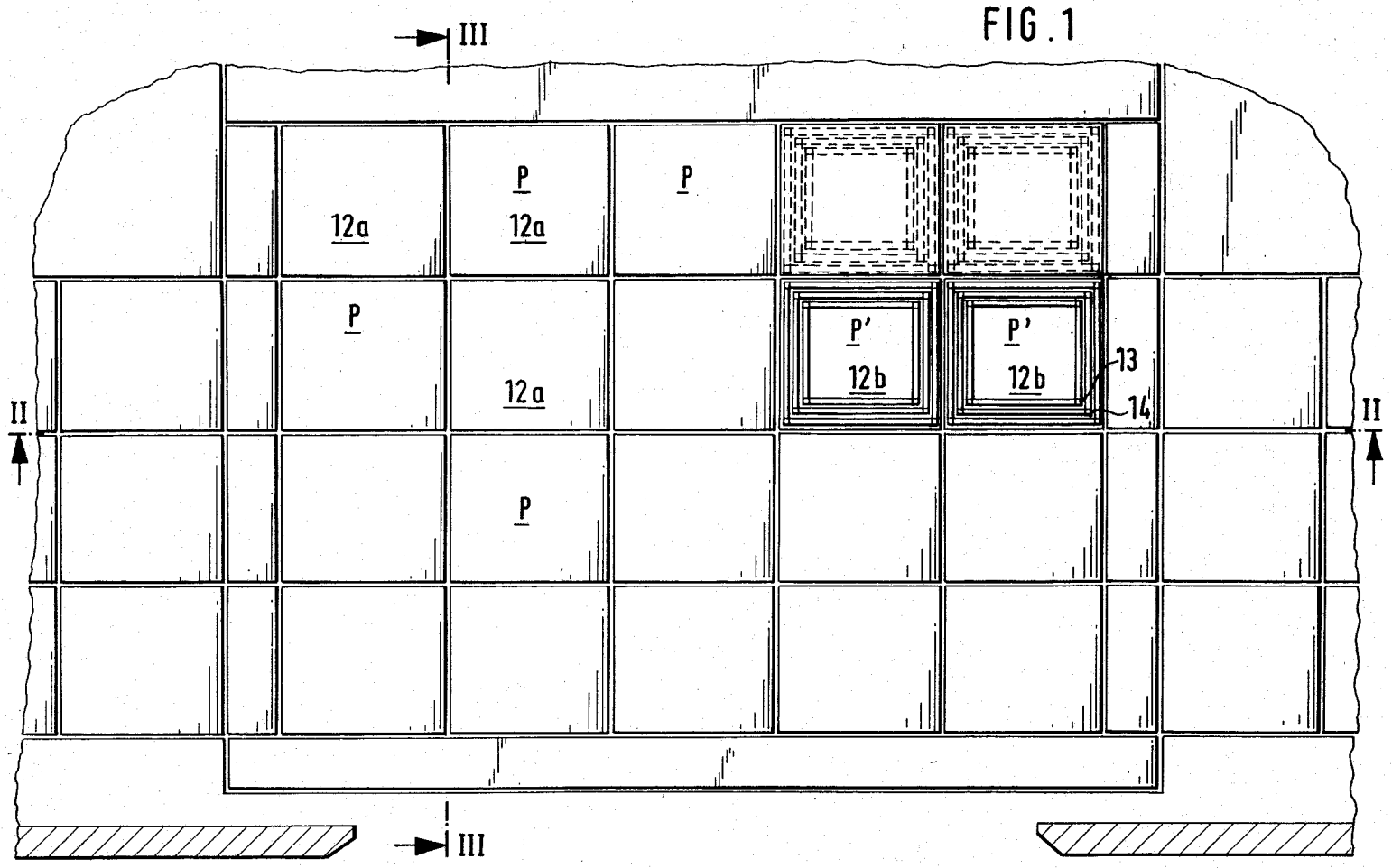
FIG. 1 is a plan view of the preferred embodiment.

The preferred embodiment shown in plan in FIG. 1 is an array of raisable and lowerable pedestals P. Each pedestal P has an upper platform 12*a* and a lower platform 12*b* both of which interfit to form at least a portion of a stage, the upper platforms 12*a* on pedestals P′ being removed to show the lower platforms 12*b*.

Figure 2:
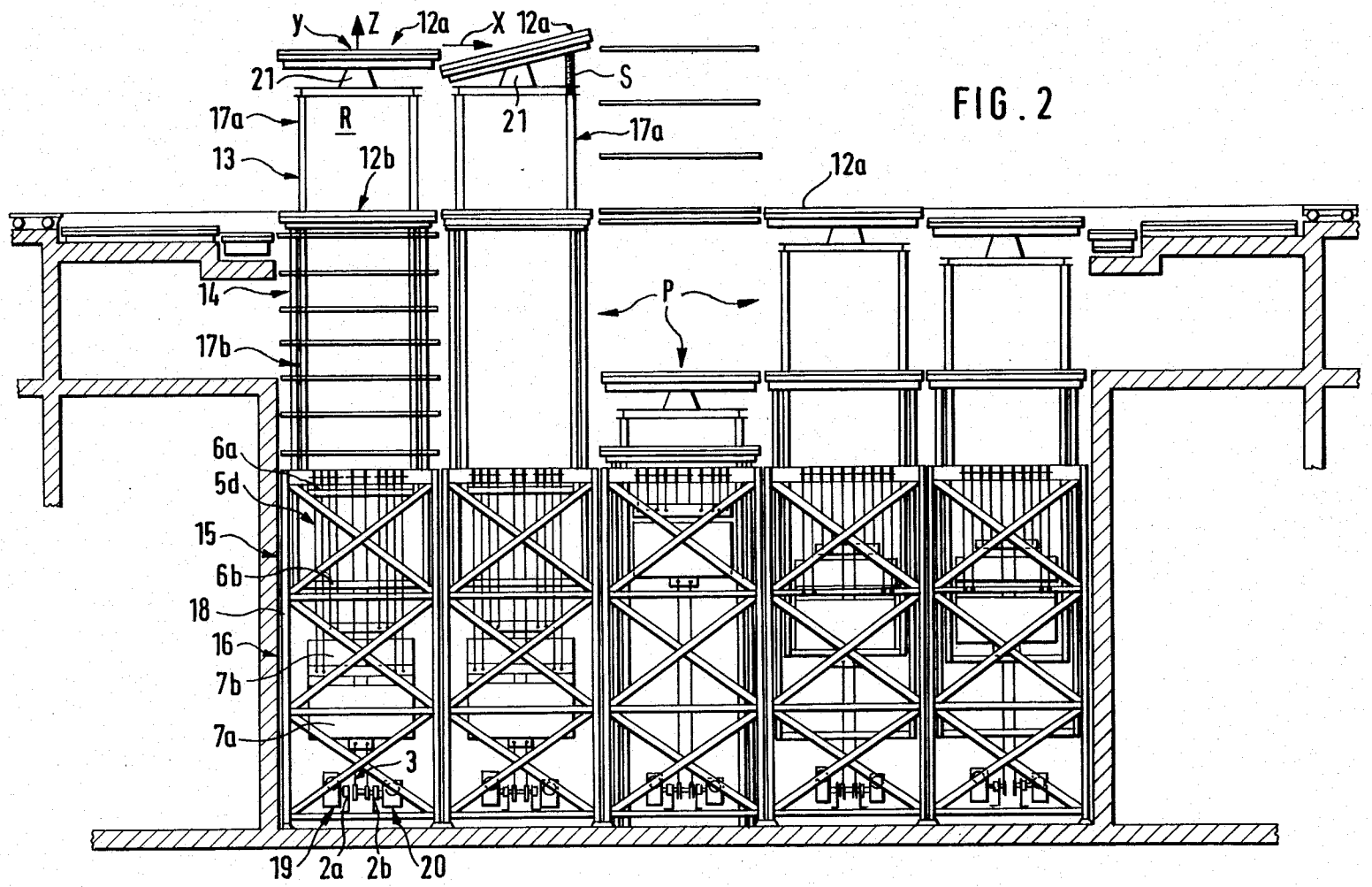
FIG. 2 is along the line II—II in FIG. 1.
Figure 3:
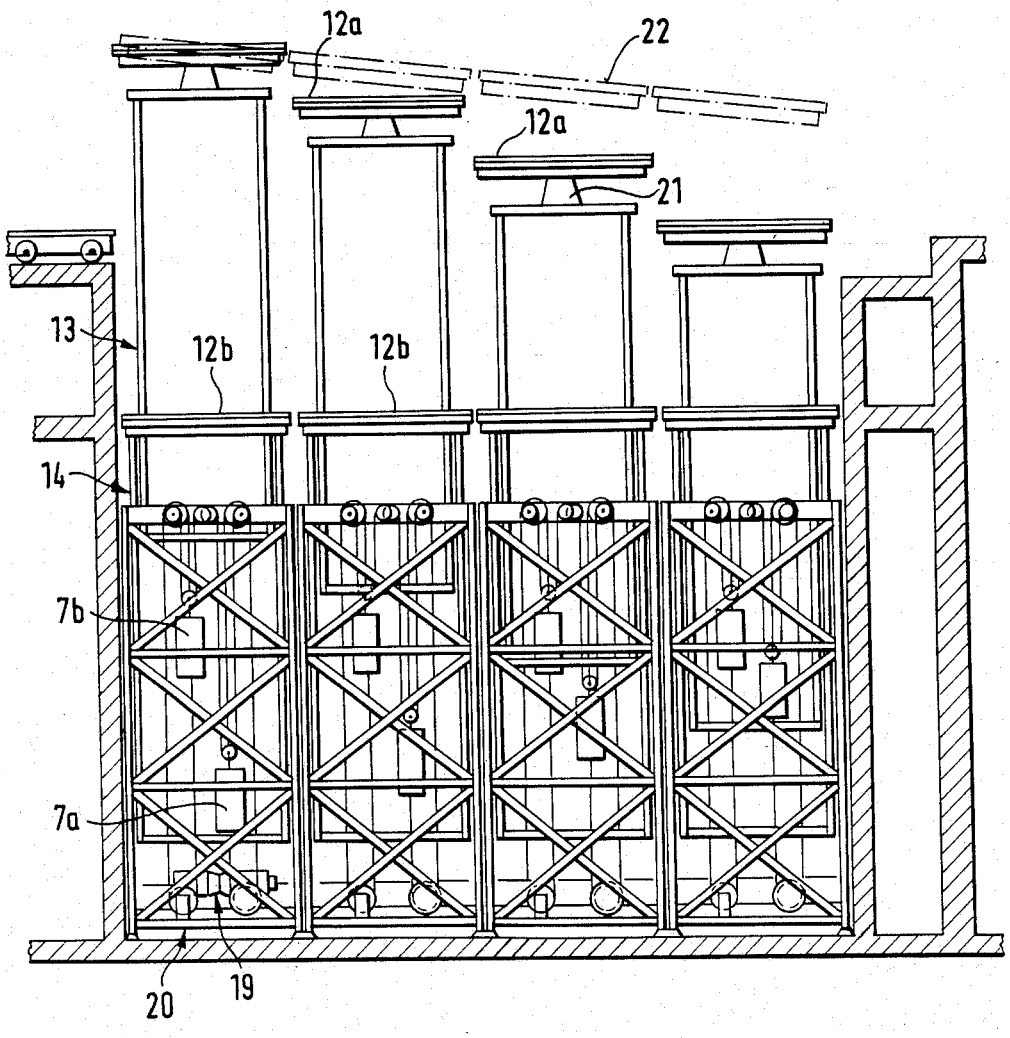
FIG. 3 is an elevation, partly in section, of the preferred embodiment along the line III—III in FIG. 1.

As shown in FIGS. 2 and 3, each pedestal P is the same. In each, the lower platform 12*b* is carried on one end of a second or lower steel framework structure 14 and the upper platform 12*a* is carried on the corresponding end of a first or upper steel framework structure 13 which telescopically nests in the second.

Figure 5:
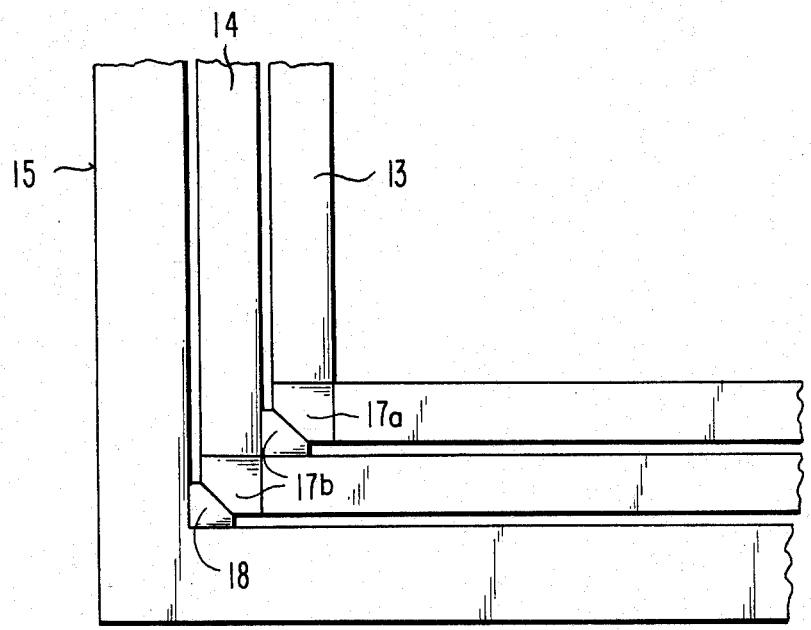
FIG. 5 is a partial, plan view of the preferred embodiment with platform portions removed.

The lower steel structure 14 is, in turn, supported extensibly in another steel framework structure 15 of the arrangement for raising and lowering the others. Structure 15 is anchored in a pit surrounded by concrete walls 16. Guidance of the upper and lower steel structures 13, 14 is effected by respective corner posts 17*a*, 17*b*, thereof each corner post 17*b* also being slidably guided in a corner post 18 of the structure 15 as best shown in FIG. 5. All the corner posts are machined over their full length for this. Due to this feature, the guiding function is integrated in the supporting function.

First, and second motor/gear units 19, 20 are solidly connected to the structure 15. The upper and lower steel structure 13 and 14 are respectively drivable up and down separately or in synchronism by the first and second motor/gear units 19, 20. The first gear unit 19 is of a greater size than the second gear unit 20 because it is required to support the load usually resting on the raisable and lowerable platform 12*a*, which load being the fluctuating, "live" load of stage use, cannot be fully compensated by counter weights. The gravity or "dead" weight the upper and lower steel structures 13, 14, however, is compensated by counterweight 7*a* for the upper steel structure 13 and counterweight weight 7*b* for the lower steel structure 14, the arrangement of correspondingly designed chain and pulley drive systems for interconnecting the structures 13, 14 and counter weights *7a*, *7b* through motor/gear units 19, 20 being shown in FIG. 4 and described below. In general, however, the force transmission is on a symmetrical pattern and effected by chains 3 which are driven by chain sprockets *2a*, *2b*. The lifting chains *5d* for the upper or lower steel structures are secured to the transverse members *6a*, *6b* of the steel structures, structure 13 being illustrated in FIG. 4.

The upper steel structure 13 carries at its top a framework on which the upper platform *12a* is mounted in manner permitting cardanic flexibility via a universal joint bracket 21. In the typical embodiment illustrated, the upper platform *12a* can be tilted 15° in all directions. The tilting mechanism is formed by screw drives (not shown) and screws S (only one shown in FIG. 2) which are arranged in the corner posts *17a* of the upper steel structure 13.

Thanks to the lifting and lowering motions which can be performed separately by each of the raisable and lowerable pedestals P in conjunction with a tilting motion, all conceivable contours of the stage floor can be produced. The first two platforms *12a* from the left in FIG. 2 are thus shown in a raised position and the next in the lowered position, one of the raised platforms *12a* being shown in a tilted position. The remaining two platforms *12a* are shown in the zero or level position. In FIG. 3, the platforms *12a* are so extended that steps are formed, and by then tilting them about a horizontal axis, an incline 22 can be formed therefrom as shown in the alternative.

The lower steel structure 14, as with the upper steel structure 13, is closed at the top by a second platform *12b*. This makes it possible, for instance, to represent a room as at R (FIG. 2) in that the platform *12b* of the lower steel structure 14 forms the floor, the framing of the upper steel structure 13 the walls, and the platform *12a* thereon the ceiling of the room.

Figure 4:
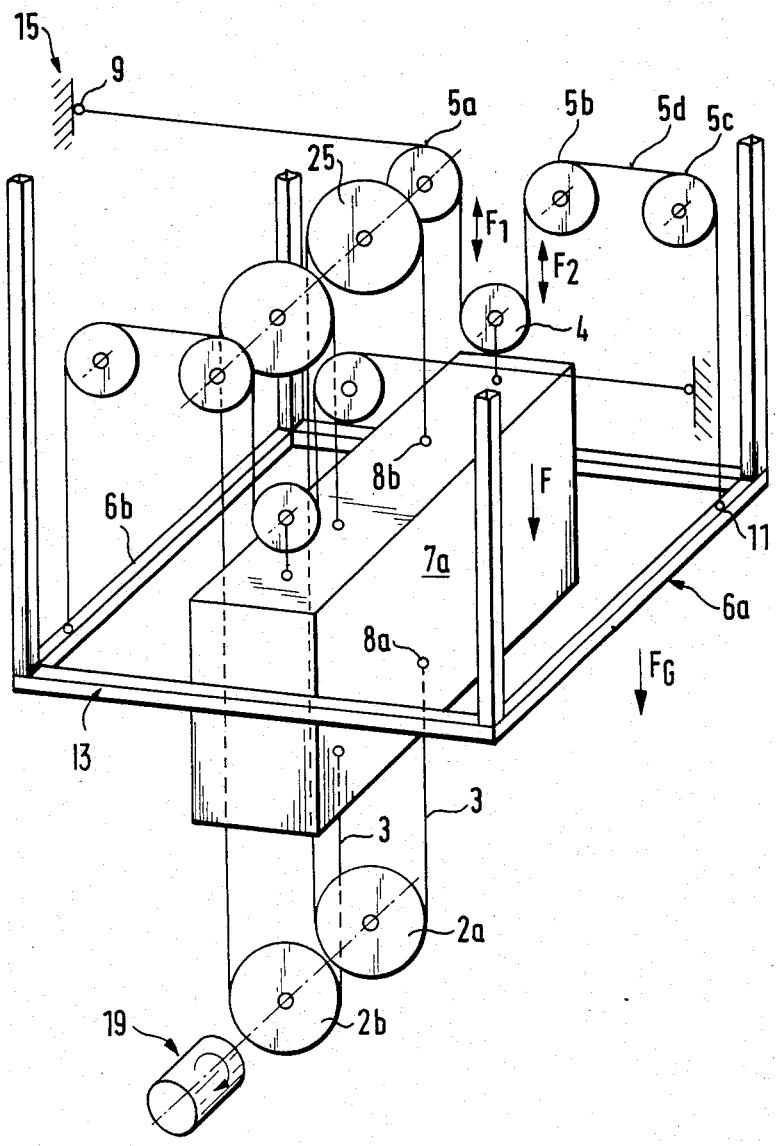
FIG. 4 is a schematic representation of a chain drive for part of the preferred embodiment.

FIG. 4 shows in detail the mechanism for the arrangement by which each of the upper and lower structures 13, 14 are raised and lowered. These mechanisms are the same for each structure so that only the one for structure 13 is shown and described.

Motor/gear unit 19 turns the sprocket wheels *2a*, *2b*, each of which engages a circulatory or C chain 3. Since the system for each chain 3 is symmetrical, only the elements for one has been provided with reference numbers.

The power flow from motor/gear unit 19 is directed so that the circulatory chain 3 first of all raisably and lowerably drives counterweight *7a* to which it is connected at chain ends *8a*, *8b* after passing about idler 25 rotatably on structure 15. The counterweight *7a*, in turn, is connected to a moving pulley 4, the gravity force F due to the weight of the counterweight *7a* thus being divided between the two sides of a lifting chain *5d* which passes round the pulley 4 so that each of the two forces F1, F2 therein equals F/2. The lifting chain *5d* passes from moving pulley 4 to deflection pulleys *5a* to *5c* supported rotatably in structure 15 in a way which is not shown for clarity. One end of chain *5d* is connected at point 11 to structure 13; the other end of the lifting chain *5d* is connected at point 9 to the stationary structure 15. The counterweight *7a* is therefore dimensioned so that the gravity force F due to its weight equals or is less than two times the force F of the weight of structure 13.

It will be understood that the specification and examples are illustrative but not limitative of the present invention and that other embodiments within the spirit and scope of the invention will suggest themselves to those skilled in the art.

What is claimed:

1. A pedestal unit for a theater stage, comprising:

first and second structures each having a platform on a corresponding end, the first structure being telescopically nestable in the second structure with the platform thereof on top of the platform of the second structure, whereby to be an upper platform; and a framework about the structures having means therein comprising a motor-driven chain and counterweight unit for each structure for raising and lowering the first structure relative to the second and, independently, raising and lowering the first structure with the second relative to the framework, whereby the platforms of the structures can be variably spaced from each other as well as raised and lowered relative to a fixed reference.

2. The pedestal of claim 1, wherein the first and second structures are frameworks having posts at corresponding positions of cross sections transverse to the directions in which the structures are raisable and lowerable, the posts interfitting all along their lengths, whereby to provide stable guidance in both the raising and lowering directions and directions transverse thereto.

3. The pedestal of claim 2, wherein the framework about the structures has posts at positions of a cross section thereof transverse to the directions in which the structures are raisable and lowerable corresponding to the posts of the structures, the posts of the framework about the structures interfitting all along their length with the posts of at least one of the structures.

4. The pedestal of claim 2, and further comprising pivot means connecting the upper platform to the first structure for tilting movement about at least one axis transverse to the directions in which the pedestal is raisable and lowerable.

5. The pedestal of claim 3, and further comprising pivot means connecting the upper platform to the first structure for tilting movement about at least one axis transverse to the directions in which the pedestal is raisable and lowerable.

6. The pedestal of claim 4, and further comprising screws threaded into at least some of the posts of the first structure and engaging the upper platform thereof for controlling the tilt of the upper platform.

7. The pedestal of claim 5, and further comprising screws threaded into at least some of the posts of the first structure and engaging the upper platform thereof for controlling the tilt of the upper platform.

8. The pedestal of claim 1, wherein each motor-driven chain and counterweight unit further comprises a pulley system on the chain of the unit and the counterweight weighs more than the associated structure.

9. A pedestal unit for a theater stage, comprising:

first and second structures each having a platform on a corresponding end, the first structure being telescopically nestable in the second structure with the platform thereof on top of the platform of the second structure, whereby to be an upper platform;

a framework about the structures having means therein comprising for raising and lowering the first structure relative to the second and, independently, raising and lowering the first structure with the second relative to the framework, whereby the platforms of the structures can be variably spaced from each other as well as raised and lowered relative to a fixed reference; and pivot means connecting the upper platform to the first structure for tilting movement about at least one axis transverse to the directions in which the pedestal is raisable and lowerable.

* * * * *